United States Patent [19]

Kohori

[11] 4,231,379

[45] Nov. 4, 1980

[54] ASH TRAY

[76] Inventor: Yoshinori Kohori, 43-3, 3-chome, Aoyamadai, Suita, Japan

[21] Appl. No.: 969,332

[22] Filed: Dec. 14, 1978

[30] Foreign Application Priority Data

Jan. 10, 1978 [JP] Japan ..... 53-1729[U]
Jan. 13, 1978 [JP] Japan ..... 53-3263[U]

[51] Int. Cl.[3] ..... A24F 13/18; A24F 19/14

[52] U.S. Cl. ..... 131/235 R; 131/238; 55/385 G

[58] Field of Search ..... 131/235, 231, 242, 238; 55/385 G; 220/223

[56] References Cited

U.S. PATENT DOCUMENTS

| | | | |
|---|---|---|---|
| 253,510 | 2/1882 | Clare | 220/22.3 |
| 2,327,036 | 8/1943 | Gerner | 131/242 X |
| 2,798,498 | 7/1957 | Aghnides | 131/242 X |
| 3,720,346 | 3/1973 | Cypher | 220/22.3 |
| 3,921,646 | 4/1973 | Kosta | 131/238 |
| 3,966,442 | 6/1976 | Waters | 131/231 |
| 4,043,776 | 8/1977 | Orel | 131/238 |

FOREIGN PATENT DOCUMENTS

| | | | |
|---|---|---|---|
| 580099 | 6/1933 | Fed. Rep. of Germany | 131/242 |

*Primary Examiner*—Stephen C. Pellegrino
*Attorney, Agent, or Firm*—Armstrong, Nikaido, Marmelstein & Kubovcik

[57] ABSTRACT

An ash tray adapted to support a smoke producing object such as a cigarette or a cigar, is provided. The ash tray comprises a body including a wall which defines an enclosed interior space. At least one aperture for accepting the cigarette is formed in the wall, the aperture defining an opening into the interior space. A flange is formed on the wall adjacent to and below the aperture, the flange being adapted to support the cigarette inserted through the aperture. The smoke from the cigarette will be trapped within the enclosed interior space and after a predetermined time the burning cigarette will be extinguished.

6 Claims, 4 Drawing Figures

ASH TRAY

BACKGROUND OF THE INVENTION

1. Field of the Invention

This invention relates to a health promoting safety ash tray adapted to support a smoke producing object such as a cigarette or a cigar.

2. Description of the Prior Art (Prior Art Statement)

The smoke from the cigarette deposited on an ash tray, tends to permeate the environment of the room, and the smoke can be injurious to the health of those who must breathe the smoke in the room. For this reason, various devices have been provided for filtering and deodorizing the smoke from the cigarette or the cigar in an ash tray. One of these devices is disclosed in U.S. Pat. No. 4,043,776. This device comprises an ash tray which supports a shroud for confining the smoke, the shroud having a mouth. The shroud in turn supports a motorized fan which creates a flow of air. A filter is located between the shroud and the fan. The flow of air begins in proximity to the ash tray at the mouth and carries the smoke through the filter.

This device has the motorized fan which renders the device complex and costly. Further, the flow of air created by the fan blows on the fire of the cigarette in the ash tray so that the fire is never extinguished. Thus, if a lighted cigarette drops on the floor or other place from the ash tray, the cigarette sometimes causes a fire.

SUMMARY OF THE INVENTION

The object of this invention is to provide a health promoting and safety ash tray which has overcome the above problem.

The ash tray comprises a wall means for defining an enclosed interior space, at least one aperture means formed in the wall means for defining an opening into the interior space, and a flange means formed adjacent to and below the aperture means. The aperture means is adapted tc permit insertion of the cigarette and the flange means is adapted to support the cigarette inserted through the aperture means. Accordingly, the smoke from the cigarette inserted through the aperture means, is trapped within the enclosed interior space, so that the smoke does not permeate the air of the environment. Also, after a predetermined time, the burning cigarette inserted through the aperture means will be extinguished because oxygen is not offered into the enclosed interior space. Thus, there is no danger of a fire. The ash tray of this invention has a simplified structure.

Preferably, the ash tray includes a dividing wall means for dividing the enclosed interior space into a plurality of chambers, and the wall means has a plurality of aperture means, wherein one chamber is provided for each of the aperture means. In this construction, a plurality of people can use the ash tray, and the burning of the cigarette will be extinguished more quickly because the volume of the chamber is smaller than the volume of the interior space.

BRIEF DESCRIPTION OF THE DRAWINGS

Other features and advantages of the invention will appear from the description to follow of embodiments disclosed in the accompanying drawings.

In the drawings.

DETAILED DESCRIPTION OF THE PREFERRED EMBODIMENT

Figure 1:
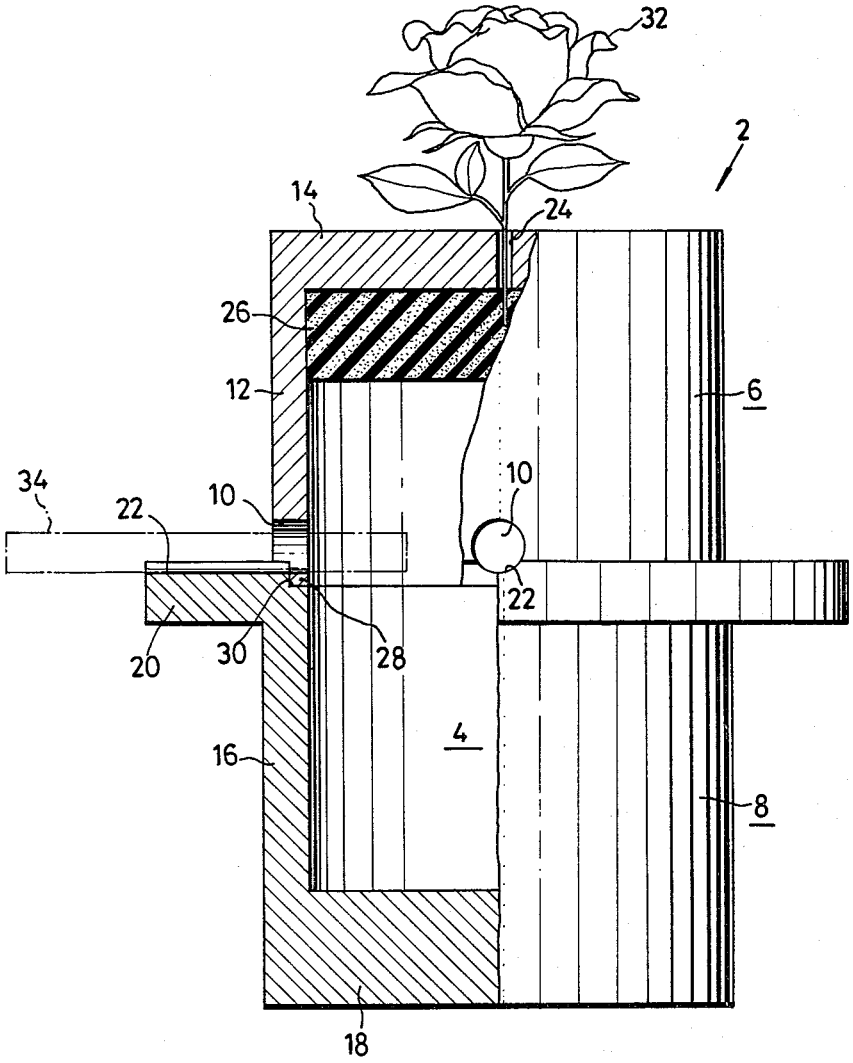
FIG. 1 is a side view partially in section of one embodiment of this invention.
Figure 2:
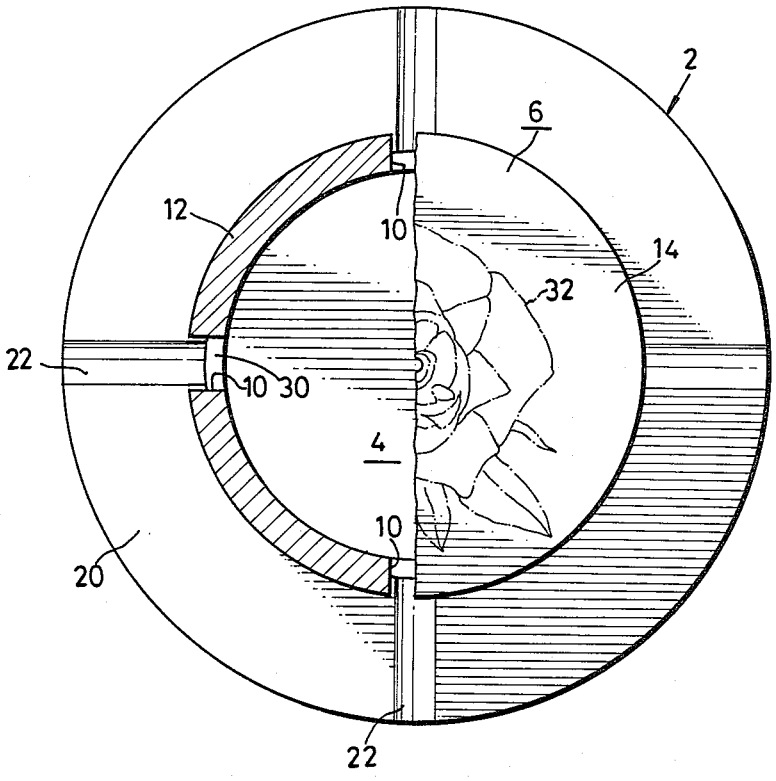
FIG. 2 is a top view partially in section of the embodiment.

Referring to FIGS. 1 and 2, an ash tray comprises a hollow body 2 having a interior space 4 inside thereof. The body 2 is of a generally cylindrical form and consists of two parts, an upper part of the body 6 and a lower part of the body 8. The upper part 6 comprises a cylindrical side wall 12 and an upper panel 14 closing the upper end thereof, the upper panel 14 having a small hole 24. The side wall 12 is provided with angularly spaced apertures 10 for accepting cigarettes at the lower portion thereof, the apertures extending from the interior space 4 to the environment and having diameters corresponding to the diameters of the cigarettes. The diameter of the aperture 10 is so determined that the cigarette can be freely inserted into the aperture 10 and the clearance between the inner surface of the aperture 10 and the cigarette is as small as possible. The side wall 12 has an annular engageable portion 28 extending downwardly from the lower end thereof. A filter 26 such as a sponge containing water is inserted into the upper part of the body 6 and is made to come closely into contact with the inner surface of the upper part 6.

The lower part of the body 8 comprises a cylindrical side wall 16, a bottom panel 18 closing the lower end thereof, and an annular flange 20 extending outwardly and horizontally from the top of the side wall 16, the side wall 16 having an annular engageable depressed portion 30 corresponding to the portion 28 of the upper part 6. The flange 20 is provided with angularly spaced radial grooves 22 adapted to receive a cigarette which is inserted through the aperture 10. The body 2 is made of metals such as aluminum, earthenware, or glass.

The upper part 6 is placed on the lower part 8 and the portions 28 and 30 are engaged with each other. The flange 20 is located adjacent to and below the apertures 10 and the positions of the apertures 10 coinside with the positions of the grooves 22 on the flange 20. The interior space 4 of the body 2 is enclosed by the upper panel 14, the bottom panel 18 and the side walls 12 and 16 except for the hole 24 and the apertures 10. The small hole 24 in the upper panel 14 is used to insert a stem of an artificial flower 32. The ash tray has the flower 32 as a kind of ornament.

The lighted cigarette 34 is inserted into the aperture 10 so that the lighted end of the cigarette is located inside of the body 2. Then, the smoke from the cigarette 34 is trapped within the enclosed interior space 4 of the body 2, so that the smoke does not permeate the air of the environment. A portion of the smoke in the space 4 may pass through the filter 26 and the small hole 24 to the environment. The small hole 24 prevents the smoke from flowing backward and passing through the apertures 10 to the environment. If the lighted cigarette 34 is inserted through the aperture 10 for at least a few minutes, the burning of the cigarette 34 will be extinguished because oxygen is not available in the enclosed interior space 4 of the body 2. It is possible to place the cigarette 34 into the body 2 by pushing the outer end of the cigarette 34. To wash the inside of the body 2, the two parts of the bodies 6 and 8 are separated from each other. The filter 26 can be used as a washing means for washing the inside of the body 2.

It is apparent that the hollow body can have any shape for example a square-shaped cross section, although the hollow body 2 in foregoing embodiment is of a generally cylindrical form. The number of the aperture is not limited. The hollow body may be provided with one aperture. The aperture and the flange may be formed at any position between the top of the hollow body and the bottom of the hollow body so long as the lighted end of the cigarette inserted through the aperture does not touch the top part or bottom part of the hollow body. In the foregoing embodiment, the flange extends around the body, however a flange means may be formed only at the portion where the aperture is located. The upper part of the body may comprises only an upper panel, and all the side walls may be included in the lower part of the body.

Figure 3:
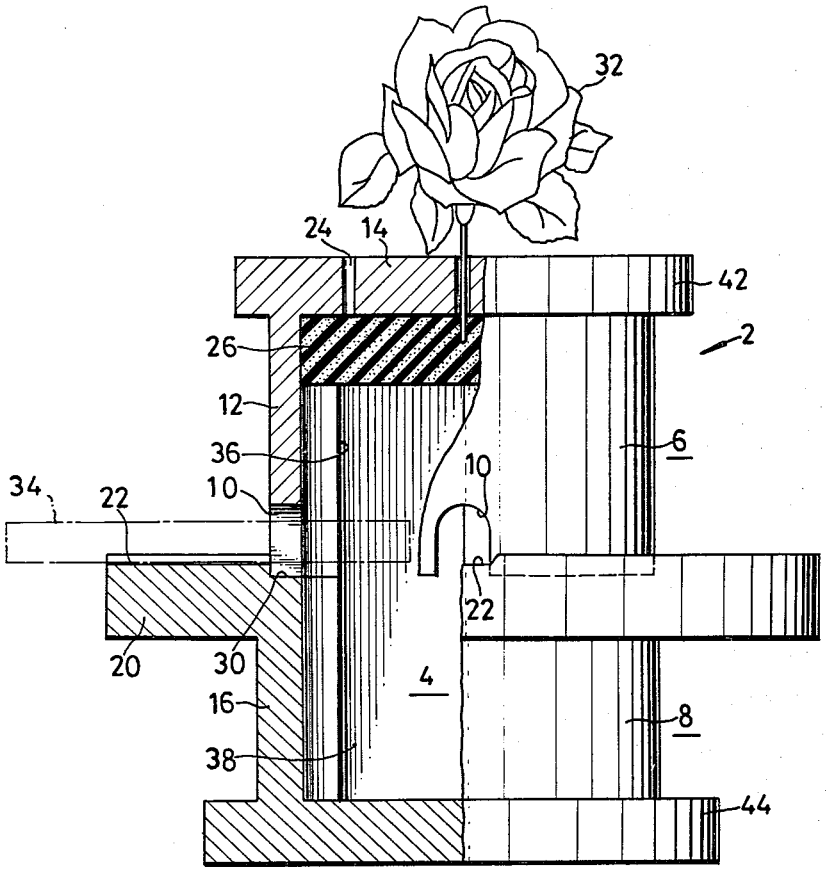
FIG. 3 is a side view partially in section of a modified form of the invention.
Figure 4:
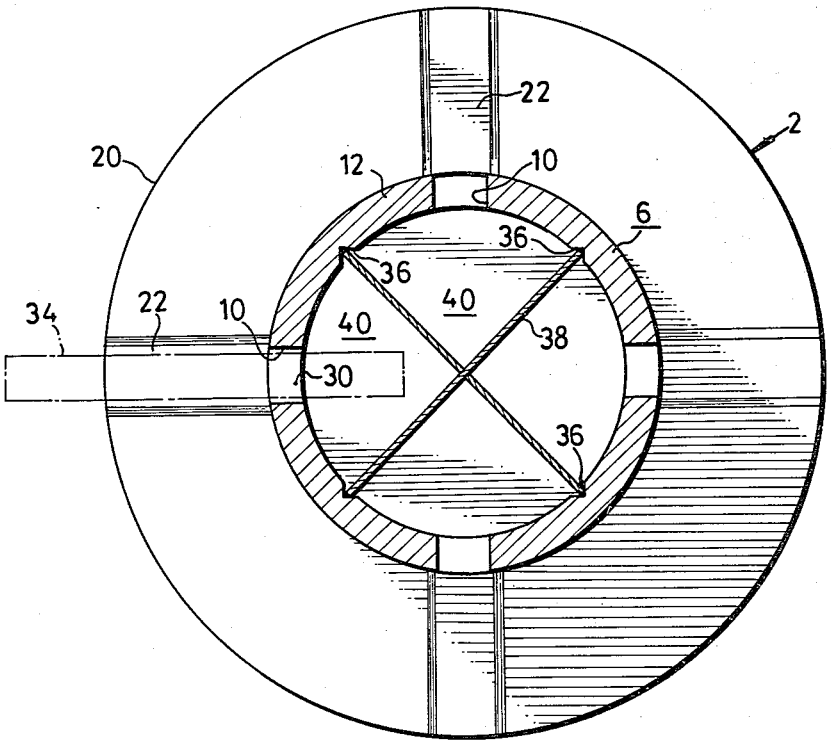
FIG. 4 is a top view partially in section of the modified form.

FIGS. 3 and 4 show a modified embodiment of this invention. In FIGS. 3 and 4, the same members as shown in FIGS. 1 and 2 are designated by the same reference numerals. The body 2 is provided with two pairs of vertically extending grooves 36 positioned at equal angles on the inside of the side walls 12 and 16. A dividing wall 38 is located in the hollow body 2 and divides the enclosed interior space 4 into four equal volume chambers 40, each chambers 40 are provided for each aperture 10. The dividing wall 38 comprises two pieces of metal plates assembled in the form of a cross-shaped cross section, each piece including edge portions. The edge portions of the dividing wall 38 are inserted into the grooves 36. The upper and lower ends of the dividing wall 38 are in abutment with the filter 26 and bottom panel 18 of the lower part 8, respectively. The apertures 10 are U-shaped and the lower end thereof is open. The lower end of the upper part 6 is inserted into the depressed portion 30 formed on the upper end of the side wall 16 of the lower part 8. The upper part of the body 6 has a flange 42 extending outwardly from the top thereof, and the lower part of the body 8 has a flange 44 extending outwardly from the bottom panel 18.

In this embodiment, the enclosed interior space 4 is divided into the equal volume chambers 40 and each chamber 40 is provided with an aperture 10, so that a plurality of people can use the ash tray. Further the burning of the cigarette 34 will be extinguished more quickly because the volume of the chamber 40 is smaller than the volume of the interior space 4.

What is claimed is:

1. An ash tray for supporting a smoke producing object, said ash tray comprising:

(a) a wall means for defining an enclosed interior space, said wall means comprising a vertically extending side wall means, an upper panel covering the upper end of said side wall means and a bottom panel covering the lower end of said side wall means;

(b) at least one aperture means formed in said side wall means for defining an opening into said interior space, said aperture means being adapted to permit insertion of said object;

(c) a flange means formed adjacent to and below said aperture means, said flange means being adapted to support said object inserted into said aperture means;

(d) at least one small hole formed in said upper panel to allow the smoke in said enclosed interior space to go out; and (e) a filter to remove the harmful substance in the smoke, said filter being located at an upper part of said enclosed interior space and arranged to come into close contact with the inner surface of said upper panel, wherein the smoke from said object is trapped within said enclosed interior space such that after a predetermined time the burning of the object will be extinguished, and wherein the smoke filling said enclosed interior space gradually flows out through said filter and said small hole.

2. An ash tray as defined in claim 1 wherein said side wall means comprises a vertically extending tubular member.

3. An ash tray as defined in claim 1 wherein said wall means comprises an upper part and a lower part, said upper and lower parts being separable from each other.

4. An ash tray as defined in claim 1 wherein said ash tray includes a dividing wall means for dividing said enclosed interior space into a plurality of enclosed chambers, wherein said at least one aperture means is a plurality of aperture means, wherein said at least one small hole is a plurality of small holes, and wherein one of said plurality of enclosed chambers is provided for each of said aperture means and at least one small hole.

5. An ash tray as defined in claim 1 wherein said ash tray includes a dividing wall means for dividing said enclosed interior space into a plurality of enclosed chambers, wherein the upper end of said dividing wall means is arranged to come into close contact with said filter, said side wall means vertically extending and being provided with a plurality of vertically extending grooves and a plurality of aperture means, said upper panel having a plurality of small holes, and wherein one of said plurality of enclosed chambers is provided for each of said aperture means and at least one said small hole, and said dividing wall means is positioned in said grooves, said dividing wall means being held in a fixed position by said grooves.

6. An ash tray as defined in claim 1 wherein said ash tray having at least one artificial flower, a stem of said artificial flower being inserted into said small hole.

* * * * *